US007383785B1

(12) United States Patent
Schmidt et al.

(10) Patent No.: US 7,383,785 B1
(45) Date of Patent: Jun. 10, 2008

(54) MOORING SYSTEM FOR WATERCRAFT

(76) Inventors: Brian Schmidt, Dalgasparken 10, Grinsted (DK) 7200; Adam Crooks, 71 Sunnybrae Road Glenfield, Auckland (NZ); Philip Barclay, 8 Pinewood Avenue, Woodlands, Perth (AU)

( * ) Notice: Subject to any disclaimer, the term of this patent is extended or adjusted under 35 U.S.C. 154(b) by 0 days.

(21) Appl. No.: 11/603,537

(22) Filed: Nov. 22, 2006

(51) Int. Cl.
*B63B 21/00* (2006.01)

(52) U.S. Cl. ..... 114/230.2; 114/293; 441/3

(58) Field of Classification Search ..... 114/230.1, 114/230.2, 230.22, 230.25, 230.26, 293, 294, 114/230.24; 441/3
See application file for complete search history.

(56) References Cited

U.S. PATENT DOCUMENTS

| | | | | |
|---|---|---|---|---|
| 129,878 | A | 7/1872 | Wilson et al. | |
| 1,801,729 | A | 4/1931 | Elliott | |
| 1,828,821 | A | 10/1931 | Short et al. | |
| 2,666,934 | A | 1/1954 | Leifheit | |
| 2,680,859 | A | 6/1954 | Hultberg | |
| 2,911,658 | A | 11/1959 | Stanley | |
| 3,049,732 | A | 8/1962 | Martin | |
| 3,077,614 | A | 2/1963 | Lloyd | |
| 3,082,439 | A | 3/1963 | Hombostel et al. | |
| 3,101,491 | A | 8/1963 | Salo | |
| 3,103,020 | A | 9/1963 | Bolton | |
| 3,103,200 | A | 9/1963 | Fulkerson et al. | |
| 3,259,927 | A | 7/1966 | Devis | |
| 3,431,568 | A | 3/1969 | Brown | |
| 3,726,247 | A | 4/1973 | Dalzell | |
| 3,838,657 | A * | 10/1974 | Fleming | 114/230.22 |
| 3,971,329 | A * | 7/1976 | Kosmatka | 114/230.22 |
| 4,303,037 | A | 12/1981 | Helveston et al. | |
| 4,509,448 | A | 4/1985 | Pease et al. | |
| 4,529,388 | A | 7/1985 | Jones et al. | |
| 5,168,823 | A * | 12/1992 | Sheppard, Jr. | 114/230.26 |
| 5,456,622 | A | 10/1995 | Breivik et al. | |
| 5,716,249 | A | 2/1998 | Dyhrberg | |

(Continued)

FOREIGN PATENT DOCUMENTS

JP 2002306862 A2 10/2002

(Continued)

*Primary Examiner*—Lars A Olson
(74) *Attorney, Agent, or Firm*—The Watson IP Group, PLC; Jovan N. Jovanovic; Vladan M. Vasiljevic

(57) ABSTRACT

A mooring system comprising a dock attachment line, a submerging member, a submerged sea anchoring line, a second submerging member and a plurality of craft attachment assemblies. The dock attachment line has a proximal end and a distal end. The proximal end is positioned at a dock and the distal end extends therefrom. The submerging member facilitates the submerging of the dock attachment line such that the distal end is positioned below the surface of the water. The submerged sea anchoring line has a first end extending from the distal end of the dock attachment line and a second end spaced apart therefrom. The second submerging member facilitates the submerging of the submerged sea anchoring line. The plurality of craft attachment assemblies extend toward the surface from the submerged sea anchoring line. Each craft attachment assembly includes a first end coupled to the submerged sea anchoring line and a second end directed toward a surface of water positioned thereabove. A buoy is positioned proximate the second end along with a craft attachment assembly which is structurally configured for retaining a watercraft at the surface of water.

11 Claims, 7 Drawing Sheets

U.S. PATENT DOCUMENTS

| | | | | |
|---|---|---|---|---|
| 5,893,334 | A | 4/1999 | Poranski, Sr. | |
| 6,109,197 | A | 8/2000 | Breivik et al. | |
| 6,227,138 | B1 | 5/2001 | Breivik et al. | |
| 6,357,378 | B1 * | 3/2002 | Hile | 114/230.2 |
| 6,390,009 | B2 * | 5/2002 | Brown et al. | 114/230.24 |
| 6,394,154 | B1 * | 5/2002 | Pollack | 441/3 |
| 6,439,149 | B1 * | 8/2002 | Hile | 114/230.1 |
| 6,488,554 | B2 | 12/2002 | Walker | |
| 6,811,355 | B2 | 11/2004 | Poldervaart | |
| 6,907,837 | B2 | 6/2005 | Pufahl | |
| 6,983,712 | B2 | 1/2006 | Cottrell et al. | |
| 2002/0117099 | A1 | 8/2002 | Walker | |
| 2003/0061980 | A1 | 4/2003 | Cottrell et al. | |
| 2003/0099517 | A1 | 5/2003 | Poldervaart | |
| 2003/0161690 | A1 | 8/2003 | Breivik et al. | |
| 2004/0040486 | A1 | 3/2004 | Pufahl | |

FOREIGN PATENT DOCUMENTS

| | | |
|---|---|---|
| JP | 2004042875 | 2/2004 |
| RU | 2035347 C1 | 5/1995 |

* cited by examiner

MOORING SYSTEM FOR WATERCRAFT

BACKGROUND OF THE INVENTION

1. Field of the Invention

The invention relates in general to a mooring system, and more particularly, to a mooring system which includes a submerged line coupled to a plurality of buoys which are spaced apart. The mooring system is configured for the mooring of watercraft (hereinafter sometimes craft), and the system may be deployable.

2. Background Art

The use of mooring systems is not new in the art. In fact, mooring systems for coupling watercraft to a dock have been in use of hundreds of years. A number of different systems have been developed to handle craft of various sizes and configurations. Nonetheless, there exists a need for improvement to these systems.

First, many of these systems are not configured to releasably retain a plurality of watercraft in a spaced apart orientation, wherein the respective distance between crafts can be adjusted so as to increase or decrease. Furthermore, many systems are not deployable and removable, rather once deployed, the structures become permanent. With certain deployable mooring systems, the use of multiple spaced apart mooring positions for multiple different craft is not shown or suggested.

It is an object of the present invention to provide a mooring system which is readily deployable and re-deployable as required.

It is another object of the present invention to provide a mooring system which is configured to retain multiple craft in a spaced apart orientation.

It is another object of the invention to provide a mooring system which includes a plurality of craft attachment assemblies extending from a submerged sea anchoring line.

These objects as well as other objects of the present invention will become apparent in light of the present specification, claims, and drawings.

SUMMARY OF THE INVENTION

The invention is directed to a mooring system comprising a dock attachment line, a submerging member, a submerged sea anchoring line, a second submerging member and a plurality of craft attachment assemblies. The dock attachment line has a proximal end and a distal end. The proximal end is positioned at a dock and the distal end extends therefrom. The submerging member facilitates the submerging of the dock attachment line such that the distal end is positioned below the surface of the water. The submerged sea anchoring line has a first end extending from the distal end of the dock attachment line and a second end spaced apart therefrom. The second submerging member facilitates the submerging of the submerged sea anchoring line. The plurality of craft attachment assemblies extend toward the surface from the submerged sea anchoring line. Each craft attachment assembly includes a first end coupled to the submerged sea anchoring line and a second end directed toward a surface of water positioned thereabove. A buoy is positioned proximate the second end along with a craft attachment assembly which is structurally configured for retaining a watercraft at the surface of water.

In a preferred embodiment, the dock attachment line further includes means for adjusting the length thereof. In one such embodiment, the adjusting means comprises a buckle assembly.

In another preferred embodiment, the dock attachment line comprises an elongated woven member.

In another preferred embodiment, the submerged sea anchoring line further comprises a plurality of submerged sea anchoring line segments. Each segment includes a first end and a second end. The first end of any subsequent anchoring line segment is coupled to the second end of a immediately preceding anchoring line segment.

In one such preferred embodiment, each submerged sea anchoring line segment further includes a ring member coupled to at least one of the first and second ends thereof.

In another such preferred embodiment, at least one submerged sea anchoring line segment further includes an adjustment assembly configured for adjustment of a length of the segment.

Preferably, at least one craft attachment assembly is positioned between successive submerged sea anchoring line segments and at a second end of a final submerged sea anchoring line segment.

In another preferred embodiment, the submerged sea anchoring line further includes an adjustment assembly configured for adjustment of a length of the line.

In a preferred embodiment, the dock attachment line submerging means further comprises a weight which is coupled proximate the distal end of the dock attachment line. In one such embodiment, the weight comprises one of a bag and a sack filled with a dense material.

Preferably, the submerged sea anchoring line attachment means further comprises a weight which is coupled proximate the second end of the submerged sea anchoring line.

In another preferred embodiment, each craft attachment assembly includes a line extending through an opening extending through the buoy.

The invention, in another aspect, comprises a method of deploying a mooring system comprising the steps of: deploying a dock attachment line; submerging a distal end of the dock attachment line with a weight; deploying a submerged sea anchoring line from the distal end of the dock attachment line; submerging a second end of the submerged sea anchoring line; and coupling a plurality of craft attachment assemblies to the submerged sea anchoring line in a spaced apart orientation therealong.

In one embodiment, the method further comprises the step of attaching a craft to at least one craft attachment assembly.

Preferably, the step of deploying a submerged sea anchoring line further comprises the step of forming a submerged sea anchoring line from a plurality of submerged sea anchoring line segments which are attached in an end to end configuration.

BRIEF DESCRIPTION OF THE DRAWINGS

The invention will now be described with reference to the drawings wherein.

DETAILED DESCRIPTION OF THE INVENTION

Figure 1:
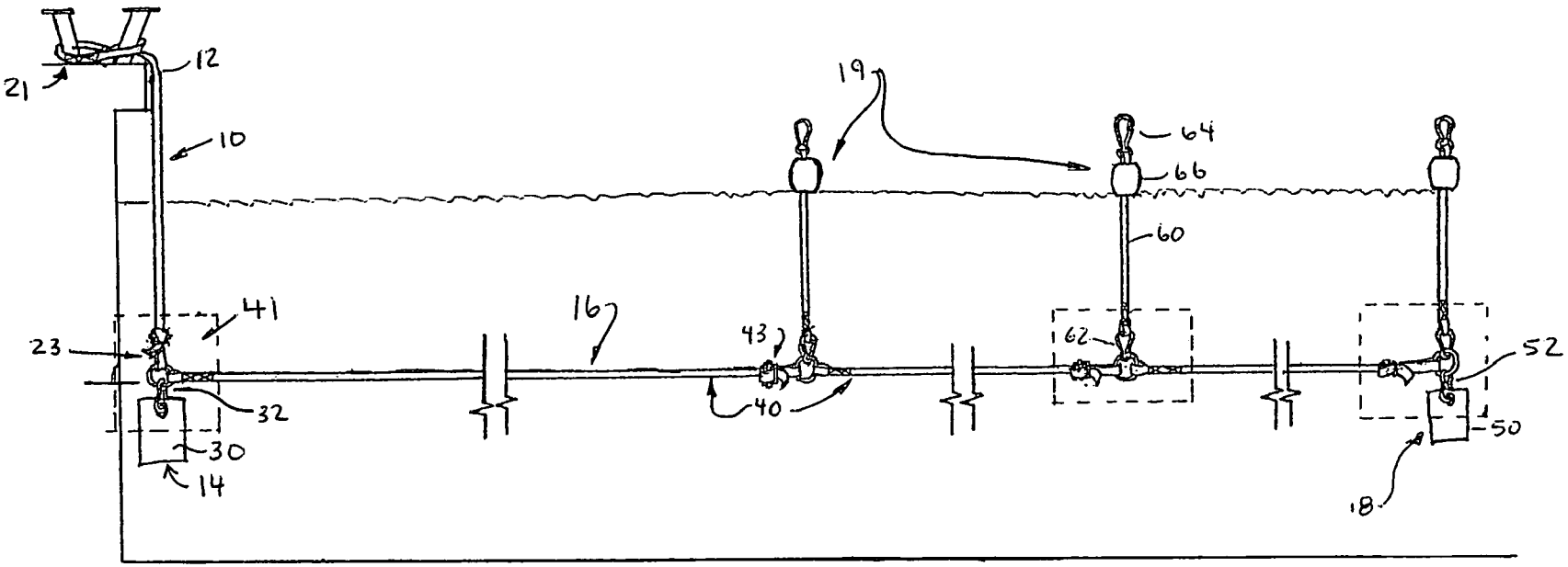
FIG. 1 of the drawings is a side elevational view of an embodiment of the invention, showing, in particular, the operation of same within a submerged environment.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, mooring system 10 is shown. Mooring system 10 is configured to retain a plurality of watercraft of various types. Indeed, the mooring system is usable in any number of different bodies of water, including both salt water and fresh water applications. The particular number of watercraft that can be coupled to the system can be varied within the scope of the invention. Additionally, it is contemplated that such a system may be routinely deployed and recollected, whereupon it may be redeployed at a later time.

With reference to FIG. 1, the mooring system 10 includes dock attachment line 12, means 14 for submerging the dock attachment line, submerged sea anchoring line 16, means 18 for submerging the submerged sea anchoring line and craft attachment assembly 19. The dock attachment line 12 preferably comprises an elongated woven member which includes a proximal end 21 and a distal end 23. For example, the line may comprise a woven nylon material which is of suitable strength. Positioned at proximal end 21 is a dock attachment region. The dock attachment region may comprise any type of structure which is configured to be releasably retained by dock structures. For example, this may include a portion of the elongated member, a clasp, a hook or the like.

At distal end 23 of the dock attachment line 12, an adjustment mechanism 20 is shown. The particular adjustment mechanism 20 is shown in further detail in FIGS. 3*a* through 3*c* as comprising a buckle 27. With such a configuration, the length of the dock attachment line can be varied so as to configure the device for operation throughout a range of depths and to allow for the user to adjust the depth of the device to insure that it is below the water a desired distance.

Figure 3C:
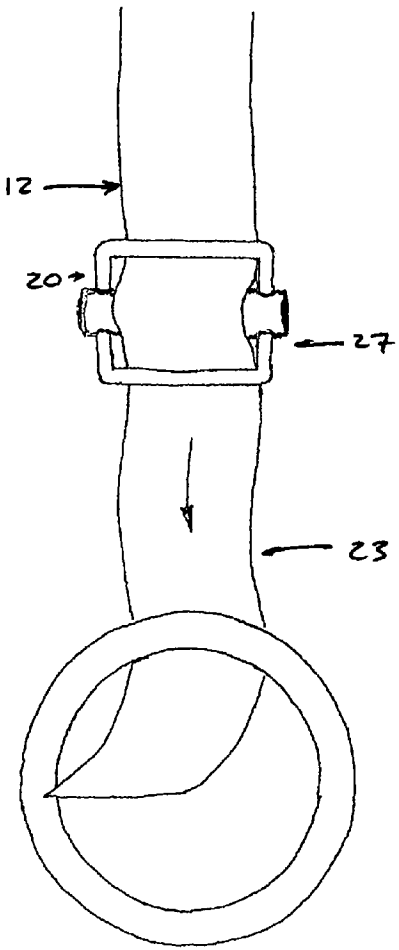
FIGS. 3*a* through 3*c* of the drawings are a sequential demonstration of the operation of the adjustment assembly (i.e., buckle assembly) of the present invention.
Figure 3B:
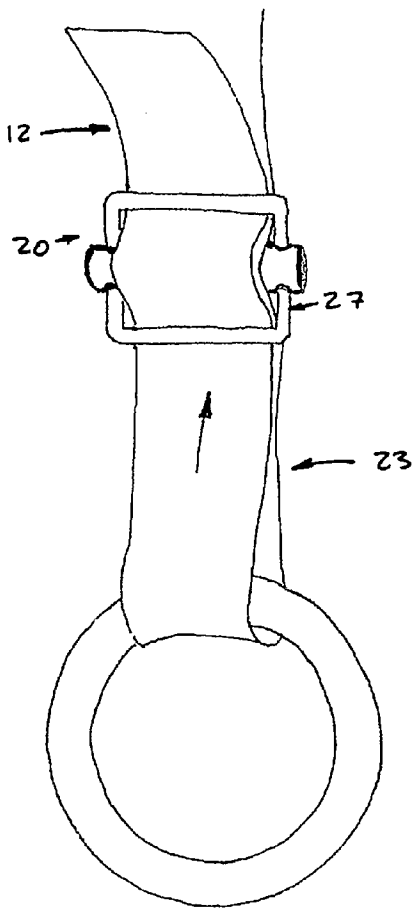
Figure 3A:
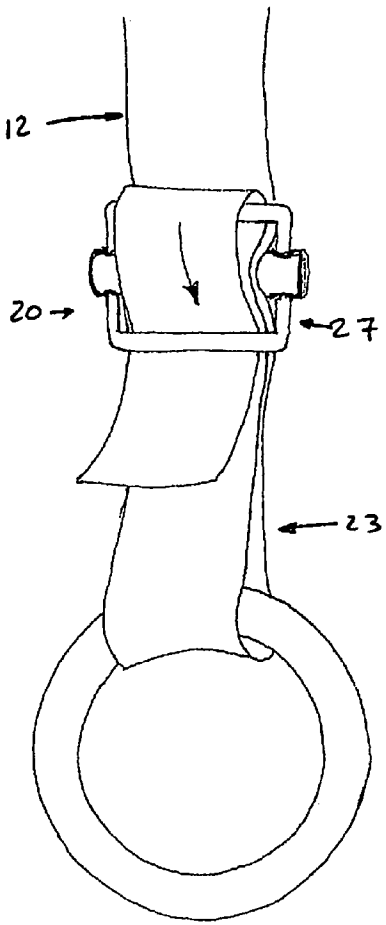

Of course, other mechanisms for adjusting the length of the dock attachment line are contemplated. For example, a number of segments may be provided which can be attached from end to end in order to vary the length of the overall dock attachment line. One of the segments can include an adjustment mechanism which may comprise that which is shown in FIGS. 3*a* through 3*c*, or which may comprise an alternate structure which relies upon straps, buckles, Velcro attachments, etc.

Figure 2:
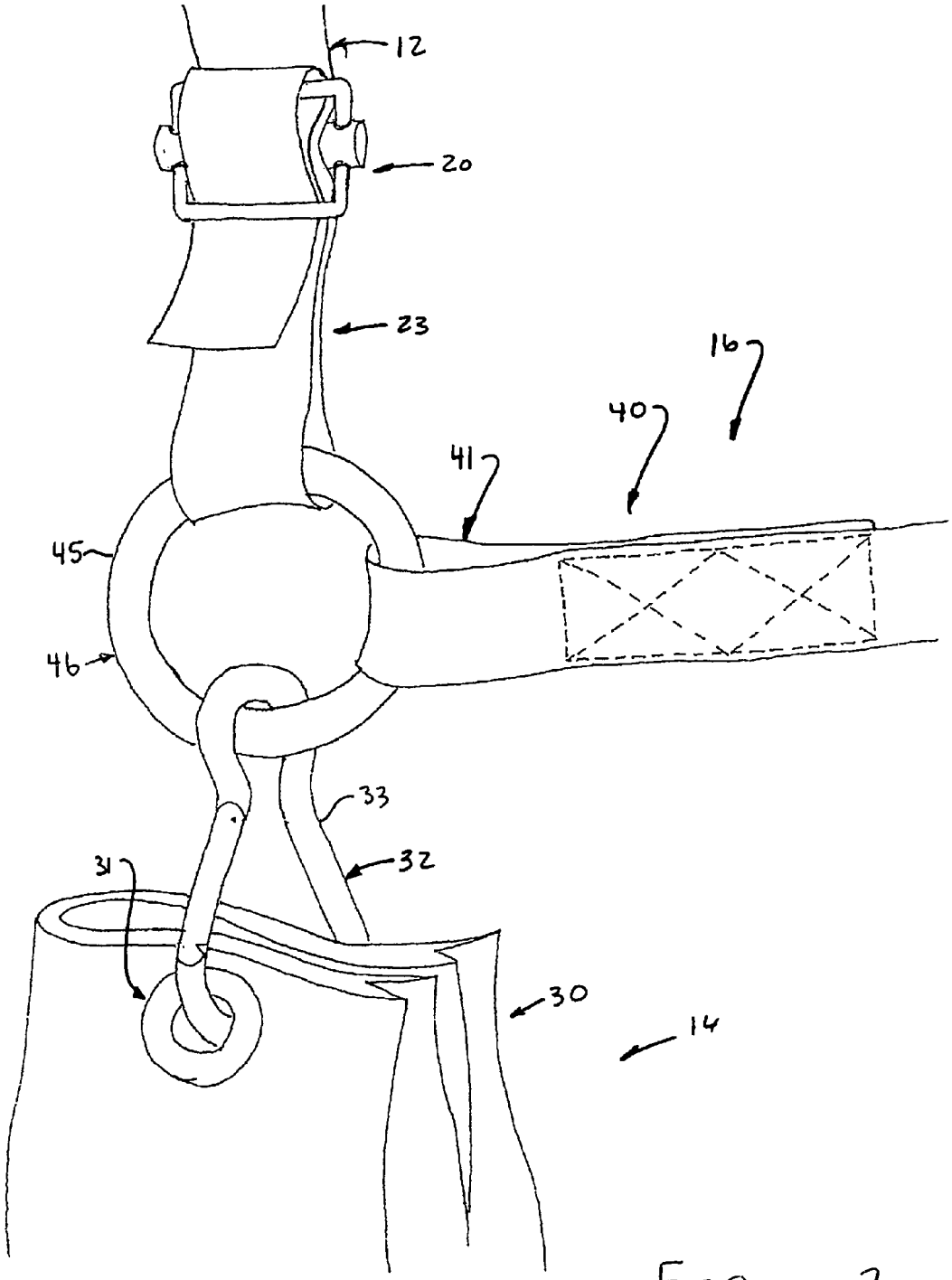
FIG. 2 of the drawings is a partial perspective view of the present invention, showing, in particular, the connection between the dock attachment line, the dock attachment line submerging means and the submerged sea anchoring line.

Submerging means 14 is shown in FIGS. 1 and 2 as comprising weight 30 and weight attachment member 32. The weight may comprise a cast metal member which is not buoyant in water (fresh or salt). In other embodiments, such as the embodiment shown, the weight may comprise a bag or sack which is filled with rocks, sand, or other dense materials. The precise mass of weight 30 can be determined based upon the watercraft which are to be attached to the system, as well as considerations based upon the prevailing tides and currents present in the area in which it is to be deployed. In the embodiment shown, the weight comprises a bag filled with a dense material. As is shown in FIG. 2, the bag includes an eyelet 31. A clasp 33 extends through the eyelet and the metal ring member of the submerged sea anchoring line (explained below) so as to be releasably retained thereby. The positioning of the eyelet provides closure to the bag and precludes the substantial removal of material from within the member.

As is shown in FIG. 1, submerged sea anchoring line 16 includes a plurality of anchoring segments 40. Each segment 40 includes first end 41 and second end 4. As is shown in FIG. 2, first end 41 is attached to an attachment member 46, such as ring member 45. As is shown in greater detail in FIGS. 4 and 6, second end 43 includes an adjustment mechanism 48 which is capable of coupling the second end to a subsequent attachment member of an additional segment 40. The adjustment mechanism may be of the type shown in FIGS. 3*a* through 3*c*.

In the embodiment shown, a total of three segments 40 are attached end to end. As can be seen from FIG. 1, each segment is of a different length. It is contemplated that a greater or fewer number of segments may be utilized. In other embodiments a signal segment may be utilized, wherein multiple craft attachment mechanisms are coupled to a single segment along the length thereof.

Figure 6:
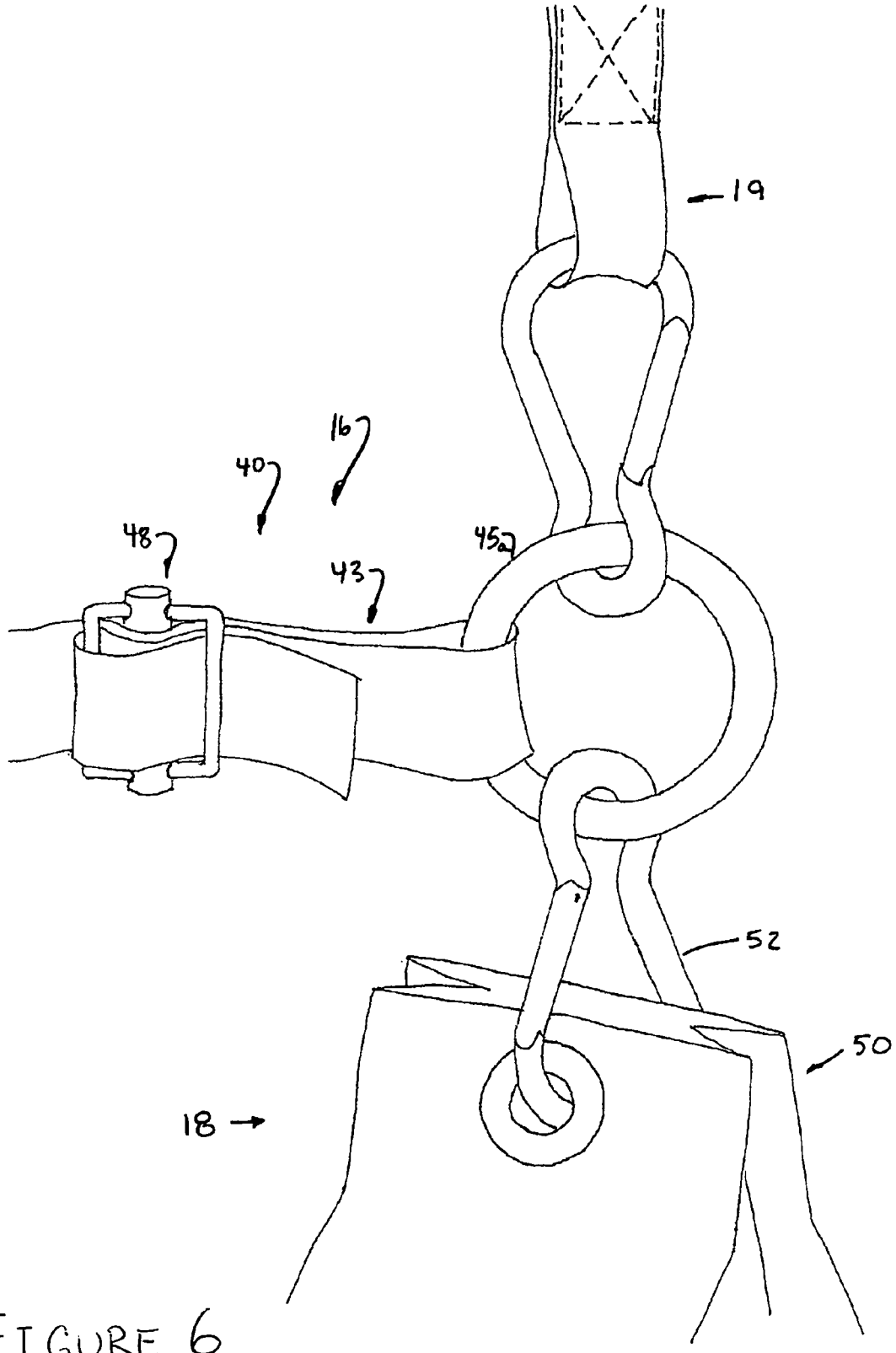
FIG. 6 of the drawings comprises a partial perspective view of the present invention, showing, in particular, the connection between the submerged sea anchoring line, the submerged sea submerging means and the final craft attachment assembly.

Submerged sea anchoring line submerging means 18 is shown in FIGS. 1 and 6 as comprising weight 50 and weight attachment member 52. The weight 50 may comprise a weight similar to that of weight 30, and the attachment member 52 may be similar to weight attachment member 32. Indeed, the mass of the weight can be determined based upon the same factors utilized for determining the mass of the weight 30. The weight can be coupled to a final ring coupled 45*a* to the second end of the final segment 40. In other embodiments, it is contemplated that additional weights may be positioned along the submerged sea anchoring line, such as between each segment.

Figure 4:
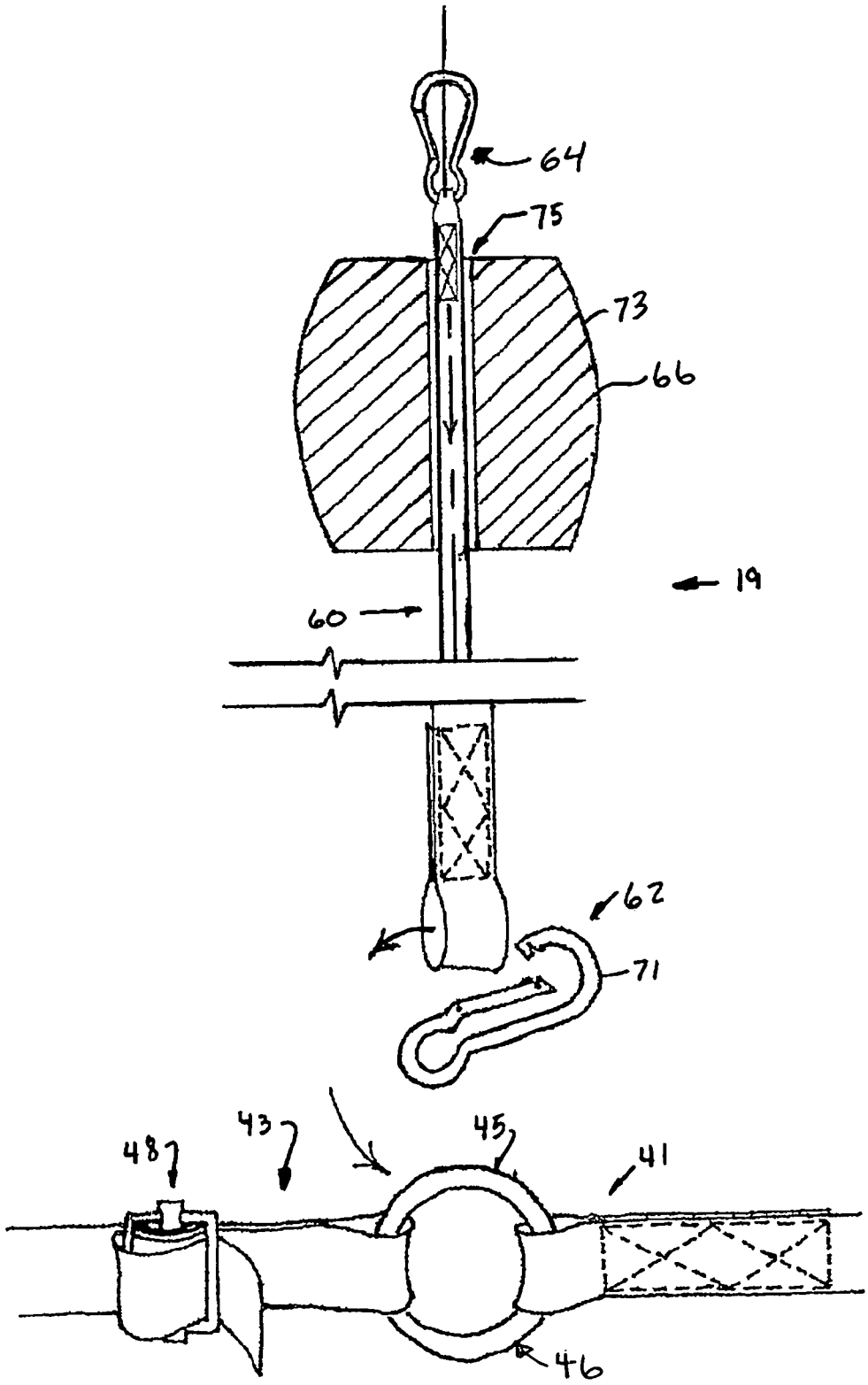
FIG. 4 of the drawings comprises a partial perspective view of the present invention, showing, in particular, the coupling of a craft attachment line to the submerged sea anchoring line.
Figure 5:
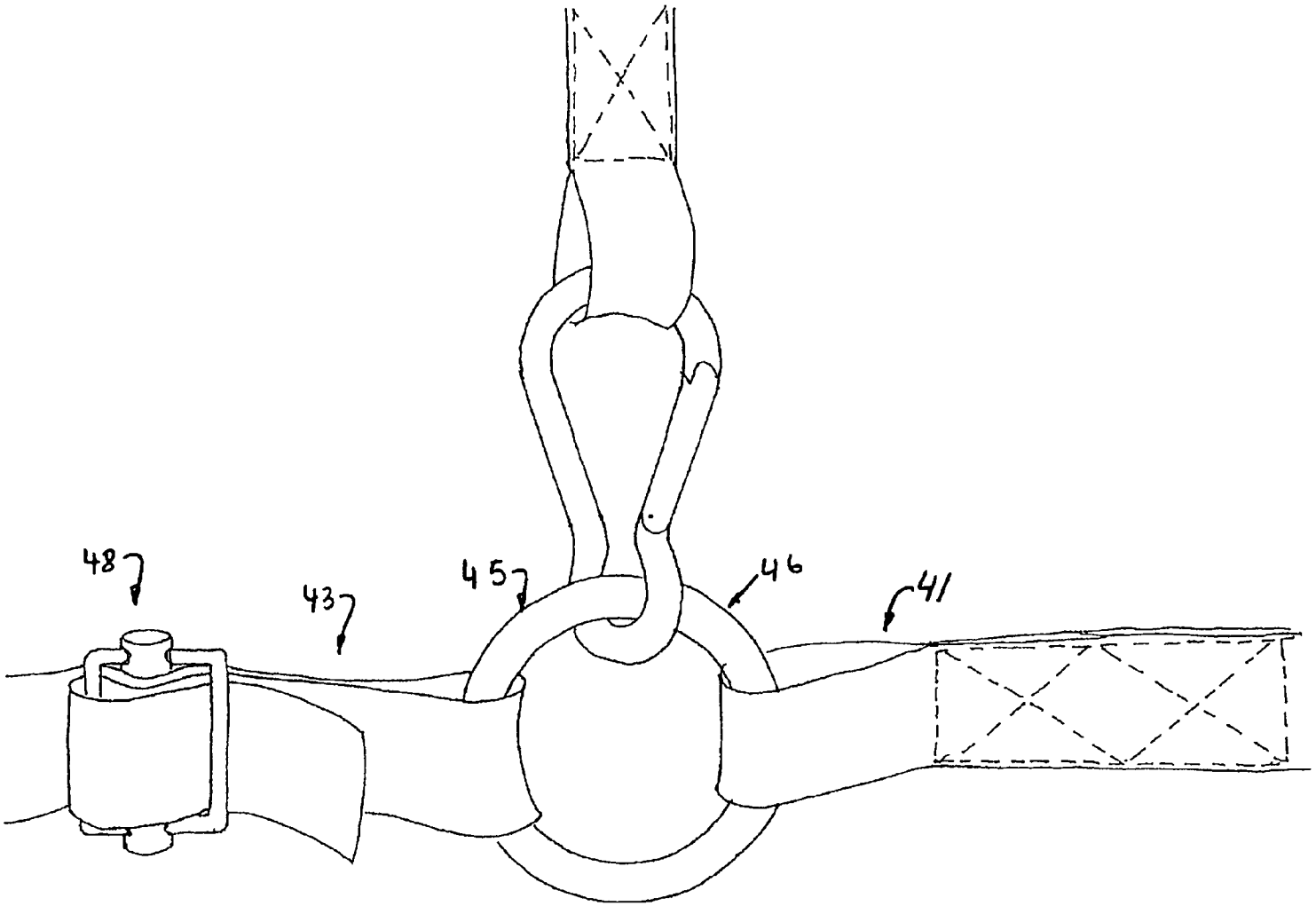
FIG. 5 of the drawings comprises a partial perspective view of the present invention, showing, in particular, the connection between successive submerged sea anchoring line segments with a craft attachment line.

Craft attachment assembly 19 is shown in FIGS. 1 and 4 as comprising attachment line 60, submerged sea anchoring line attachment assembly 62, watercraft attachment assembly 64 and buoy 66. The attachment line 60 comprises a woven elongated member which includes two loops at either end. The loops are formed by folding over the respective ends and stitching a portion of the overlapping material to leave a loop. Of course, other attachment structures are likewise contemplated, such as Velcro structures, mechanical members, eyelets, etc.

Submerged sea anchoring line attachment assembly 62 is shown in FIG. 4 as comprising clasp 71 which is configured to clasp both the loop and a metal ring member of the submerged sea anchoring line. Of course, other systems, such as carabineers, straps, buckles and eyelets are contemplated for use. A similar structure may be utilized for the watercraft attachment assembly 64.

Buoy 66 is shown in FIG. 4 as comprising a body 73 having an opening 75 extending therethrough. The body 73 comprises a member which is buoyant when placed in water (salt or fresh), and which can maintain the watercraft attachment assembly in a buoyant condition. Preferably, the attachment line extends through opening 75, terminating with the watercraft attachment assembly.

In use, it is first necessary to assemble the mooring system of the present invention. A determination is first made as to the depth at which the anchoring line is to be positioned, proximate a dock (or other area from which the device will be moored, such as a boat in the open water, for example). Second a determination is made as to how many craft attachment assemblies 19 will be utilized with the mooring system. It will be understood that the preliminary determination may be adjusted at a later time. For example, additional craft attachment assemblies can be added or removed after the initial implementation in a number of different manners.

To initiate assembly, a dock attachment line is provided. Next, a first submerged sea anchoring line is provided. The distal end of the dock attachment line is coupled to the first end of the first submerged sea anchoring line. Specifically, the buckle assembly of the dock attachment line is coupled to the metal ring member at the first end of the submerged sea anchoring line. As the buckle assembly forms the adjustment mechanism 20 of the dock attachment line, the buckle assembly is manipulated until the dock attachment line is configured to the proper length.

Next, the dock attachment line submerging means is coupled to the metal ring member (or otherwise to the distal end of the dock attachment line). More simply, weight 30 is attached to the dock attachment line or the submerged sea anchoring line with the weight attachment member 32. In the embodiment shown, where the weight 30 comprises a bag or sack having dense contents, it may likewise be necessary to fill the bag or sack with nearby sand and rocks to complete the formation of the weight.

Just as with the dock attachment line, the submerged sea anchoring line is adjusted in length utilizing the anchoring adjustment assembly. Furthermore, submerged sea anchoring line segments can be coupled sequentially to the first segment. At the final segment a final metal ring can be provided. Each individual segment can be adjusted in length by way of the respective adjustment means of the respective anchoring segments.

A craft attachment assembly 19 is coupled to the second end of each desired submerged sea anchoring line segment. In particular, the submerged sea anchoring attachment assembly is coupled to metal ring member provided at the first end of each of the second segment onward, and to the metal ring member positioned at the second end of the final submerged sea anchoring line segment. The craft attachment assemblies can be preconfigured with a buoy, or each respective buoy 66 can be provided after the craft attachment assembly is coupled to the submerged sea anchoring line.

Once completed, submerging means may be coupled to the final metal ring at the second end of the final submerged sea anchoring line. More specifically, weight 50 can be coupled with weight attachment member 52 to the metal ring at the end of the submerged sea anchoring line. Again, if the weight comprises a bag or sack filled with dense material, it may be first necessary to fill such a bag or sack with sand, rocks or similar dense materials.

Once the entire device is assembled, the system can be deployed. The system is deployed by first attaching the proximal end of the dock attachment line 12 to the dock. In the embodiment shown, the proximal end is merely coupled to the dock (i.e., tied thereto). Next, the distal end is dropped into the water. Inasmuch as a determination has already been made of the depth, and the dock attachment line 12 is configured to the appropriate length, the weight 30 should rest below the surface of the water at the desired depth. Once positioned, the second end of the final submerged sea anchoring line is taken away from the dock in the desired direction, at such time that the submerged sea anchoring line is substantially taut, weight 50 is released wherein it sinks to toward the seabed. At such time, the resulting buoy's remain at or near the surface and the remaining components drift toward the seabed and below the water surface a predetermined depth.

As users arrive at the mooring system, they can choose to attach to any one of the craft attachment lines 20. the two weights 30 and 50 substantially maintain the submerged sea anchoring line in a predetermined orientation. In turn, the craft attachment lines are likewise maintained in a desired configuration, wherein undesirable movement of any craft attached to the mooring system can be minimized.

Figure 7:
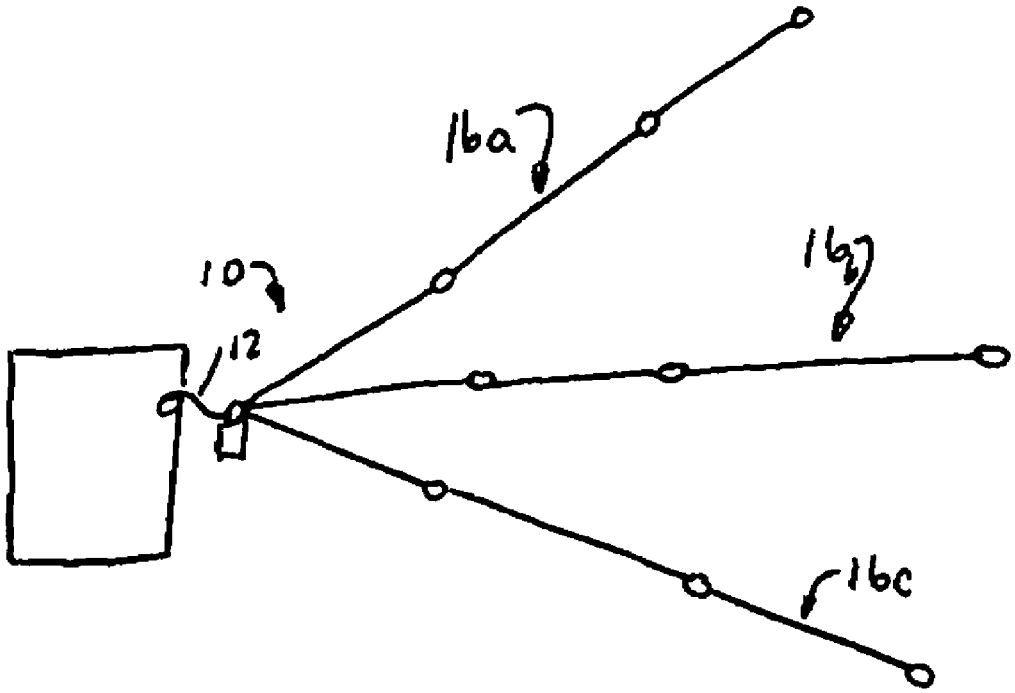
FIG. 7 of the drawing comprises an alternative embodiment wherein successive submerged sea anchoring lines extend from the distal end of a single dock attachment line.

As necessary, additional craft attachment lines can be appended to the system, as the system is not limited to any particular number of craft attachment lines. Additionally, a number of submerged sea anchoring lines can be attached to a single dock attachment line in a spaced apart orientation, as is shown in FIG. 7. For example, three separate lines **16*a* through 16*c*** can extend from a single dock attachment line, spaced apart a radial distance of approximately 45°. Furthermore, multiple segments of submerged sea anchoring lines can extend from a single point, again in a radially outward direction.

The foregoing description merely explains and illustrates the invention and the invention is not limited thereto except insofar as the appended claims are so limited, as those skilled in the art who have the disclosure before them will be able to make modifications without departing from the scope of the invention. For example, any number of different attachment systems are contemplated to attach the respective components together.

What is claimed is:

1. A mooring system comprising:

a dock attachment line having a proximal end and a distal end, the proximal end positioned at a dock and the distal end extending therefrom;

means for submerging the dock attachment line such that the distal end is positioned below the surface of the water;

a submerged sea anchoring line having a first end extending from the distal end of the dock attachment line and a second end spaced apart therefrom, the submerged sea anchoring line further comprises a plurality of submerged sea anchoring line segments, each segment including a first end and a second end, wherein the first end of any subsequent anchoring line segment is coupled to the second end of a immediately preceding anchoring line segment, means for submerging the submerged sea anchoring line;

a plurality of craft attachment assemblies extending toward the surface from the submerged sea anchoring line, each craft attachment assembly including a first end coupled to the submerged sea anchoring line and a second end directed toward a surface of water positioned thereabove, a buoy positioned proximate the second end along with a craft attachment assembly structurally configured for retaining a watercraft at the surface of water, wherein at least one craft attachment assembly is positioned between successive submerged sea anchoring line segments and at a second end of a final submerged sea anchoring line segment.

2. The mooring system of claim 1 wherein the dock attachment line comprises an elongated woven member.

3. The mooring system of claim 1 wherein the dock attachment line submerging means further comprises a weight which is coupled proximate the distal end of the dock attachment line.

4. The mooring system of claim 3 wherein the weight comprises one of a bag and a sack filled with a dense material.

5. The mooring system of claim 1 wherein the submerged sea anchoring line attachment means further comprises a weight which is coupled proximate the second end of the submerged sea anchoring line.

6. The mooring system of claim 1 wherein each craft attachment assembly includes a line extending through an opening extending through the buoy.

7. The mooring system of claim 1 wherein the dock attachment line further includes means for adjusting the length thereof.

8. The mooring system of claim 7 wherein the adjusting means comprises a buckle assembly.

9. The mooring system of claim 1 wherein each submerged sea anchoring line segment further includes a ring member coupled to at least one of the first and second ends thereof.

10. The mooring system of claim 1 wherein at least one submerged sea anchoring line segment further includes an adjustment assembly configured for adjustment of a length of the segment.

11. The mooring system of claim 1 wherein the submerged sea anchoring line further includes an adjustment assembly configured for adjustment of a length of the line.

* * * * *